United States Patent [19]

Oskarsson et al.

[11] 4,145,213

[45] Mar. 20, 1979

[54] WEAR RESISTANT ALLOY

[75] Inventors: Rolf G. Oskarsson, Rönninge; Carl S. G. Ekemar, Lännersta, both of Sweden

[73] Assignee: Sandvik Aktiebolg, Sandviken, Sweden

[21] Appl. No.: 687,341

[22] Filed: May 17, 1976

[30] Foreign Application Priority Data

May 16, 1975 [SE] Sweden ..... 7505630

[51] Int. Cl.[2] ..... B22F 3/00; C22C 29/00

[52] U.S. Cl. ..... 75/238; 75/241; 75/242

[58] Field of Search ..... 29/182.5, 182.7, 182.8; 75/203, 204, 205, 202, 238, 241, 242

[56] References Cited

U.S. PATENT DOCUMENTS

| | | | |
|---|---|---|---|
| 3,249,407 | 5/1966 | Alexander et al. | 29/182.7 |
| 3,480,410 | 11/1969 | Hummer | 29/182.7 |
| 3,649,310 | 3/1972 | Yates | 75/203 |
| 3,816,081 | 6/1974 | Hale | 75/203 |
| 3,865,586 | 2/1975 | Volin et al. | 75/203 |

*Primary Examiner*—Brooks H. Hunt

*Attorney, Agent, or Firm*—Burns, Doane, Swecker & Mathis

[57] ABSTRACT

The alloy of the invention is of the type wherein 30–70% by volume of hard components are homogeneously dispersed in a matrix of binder metal (Fe, Co or Ni). The hard components are carbides or carbonitrides and/or borides of Ti, Zr, Hf, V, Nb, Ta, Cr, Mo and/or W. The mean grain size of the hard component particles is between 0.01 and 1.0 micron and their grain size distribution, represented by the standard deviation S, in which $S^2 \leqq (M/1+1.5\ M^z)^2\ \mu m^2$, not more than 15% of the grains are larger than 1.2 microns.

6 Claims, 13 Drawing Figures

*Fig.1*

WEAR RESISTANT ALLOY

The present invention relates to an alloy having excellent properties when used in tools such as cutting, shearing or forming tools, and in construction elements and in wear parts. For use in such tools or parts a great number of materials have long been available, the same covering various ranges of uses or needs depending upon properties or efficiency of the materials in relation to their price or production costs. Among such materials can be mentioned: diamond, ceramics, hard metal, high speed steel, "stellite" and heat-treatable titanium carbide-rich alloys, for example "Ferro-TiC".

It has been attempted to cover the area or "gap" existent between (a) the large material group "hard metal" (or cemented carbide) — containing a large amount of hard components or carbides, often around 90% — and (b) the other large material group "high speed steel" — containing an amount of hard components or carbides often around 25% — by using different kinds of materials with intermediate contents of hard components or carbides. Among such materials are particularly noted the mentioned commercial alloys "stellite" and "Ferro-TiC".

Until now, however, no material has been available which has proved such properties that it has reached a general use within the mentioned intermediate area. Thus, "Ferro-TiC" has not been recommended for chip-fomring machining, because its large titanium carbide-based carbide grains — often being coherent — make the material less suitable for this use. Similarly, the material "stellite" has restricted uses, as for example hard facing, and its relatively coarse cast structure has made the material inferior in machining of metal or the like under normal conditions.

According to the present invention, there has now been made available an alloy having such properties that it covers not only the range of uses for high speed steel but also fills the "gap" between high speed steel and hard metal in a very satisfactory way. Thus, the new alloy is usable in widely varying areas, maintaining its functional properties, and is not limited to some narrow range of uses.

DETAILED DESCRIPTION OF THE INVENTION

Figure 1:
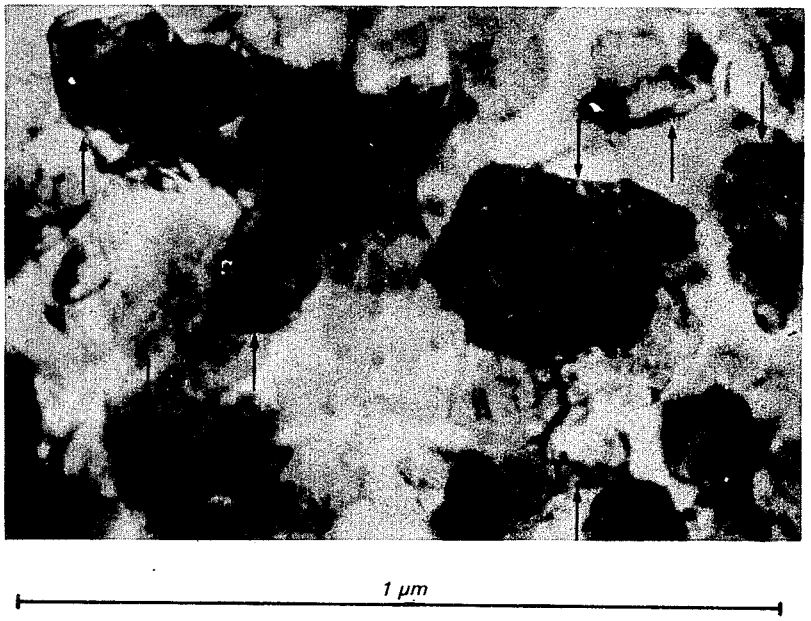
FIG. 1 is an electron microscope photomicrograph of an alloy composition of the present invention.

The new alloy, which is within a known range regarding is volume contents of alloying elements and structural components, reaches its surprisingly favorable properties by a combination including the adjusted contents and proportions of the alloying elements as well as a special and unique characterization of the grain size and size distribution of the hard components. Thus, the alloy consists of 30–70 percent by volume, preferably 35–60 percent by volume of hard components being compounds of Ti, Zr, Hf, V, Nb, Ta, Cr, Mo and/or W with C, N and/or B, in a matrix based on Fe, Co and/or Ni. Carbon, nitrogen and/or boron may be substituted by oxygen with up to 20% of the number of carbon or nitrogen or boron atoms without the properties being changed negatively.

The hard components are usually equi-axial, rounded and equally dispersed grains.

The matrix may contain different alloying elements in solution, and, besides the above-mentioned hard components it may contain further structural elements being usually present in alloys based on Fe, Co and/or Ni. These latter alloying elements, which may be present in solution or in these further structural elements, are such elements as Mn, Si, Al and/or Cu; also, alloying elements contained in the hard components. In the mentioned structural constituents also Fe, Co and/or Ni can be present. The alloy can also contain the usual impurities normally present in other alloys based upon the same elements without impaired properties. The binder phase or matrix of the alloy is often at least 50% by weight of the total.

Among the hard components of the alloy of the invention there always have to be such in which Ti, Zr and/or Hf makes the metal component as a whole or at least a certain small part thereof. It has been found that the molar ratio (V + Nb + Ta + Cr + Mo + W): (Ti + Zr + Hf) of the alloy shall be within the interval 0–1, preferably 0.01–075. The molar ratio (Ti + Zr + Hf + V + Nb + Ta + Cr + Mo + W + Al): (Fe + Co + Ni + Mn), which further precises the construction of the alloy necessary to reach surprisingly good properties, must be within the interval 0.25–0.70, and preferably 0.30–0.65. Preferably, the hard components consist mainly of nitrides and/or carbonitrides so balanced that the molar ratio N/N+C is $\geqq$ 0.35. Often is said ratio $\geqq$ 0.60. The molar ratio of the metal atoms (Ti + Zr + Hf + V + Nb + Ta): (Cr + Mo +W) is usually > 25.

The contents of Al, Mn and Si may be up to 10.15 and 4 atomic percent, respectively. The content of Cu may be up to 1 atomic percent. Preferably, the content of Al should be below 8 atomic percent while the content of Mn should not exceed 12 atomic percent. Suitably, the content of Cu is not more than 0.75 atomic percent and the content of Si at the most 3 atomic percent.

As shown, the composition of the alloy in a general form has been stated as percent hard components by volume in a metal matrix, while the presence of individual elements has been given in atomic percent or together with other elements been specified as molar ratios. The reason for the hard component part being stated in percent by volume is the different weights of the participating hard elements. Thus for example are 30 vol-% Ti + 70 vol-% Fe = 21.4 weight-% TiC + 78-6 weight % Fe, while 30 vol-% HfC + 70 vol-% Fe = 41 weight-% HFC + 59 weight % Fe. In molar percent are 30 vol-% TiC + 70 vol-% Fe = 20 molar-% TiC + 80 molar-% Fe, while 30 vol-% HfC + 70 vol-% Fe = 17 molar-% HfC + 83 molar-% Fe.

For attaining the desired properties of the alloy, it is critical that the hard components are extremely fine-grained and have a carefully precised distribution of the grain size. The mean grain size M of the hard components shall be within the interval 0.04–0.70 μm (microns), and the distribution of their grain size must be characterized of the standard deviation s in which $s^2 \leqq (M/1+1.5M^2)^2$. It is determinative for the properties of the alloy that the part of hard component grains ≧ 1.2 μm does not exceed 15% of all hard component grains. Preferably, no more than 15% of the number of grains are larger than 1.0 μm.

Among alloy compositions which have been found particularly suitable according to the invention may be noted the following compositions:

(1) 15–30% Ti, Zr and/or Hf; 15–33% C and/or N; at the most 6% Cr; at the most 6% Mo; at the most 4% W; at the most 12% Co; at the most 3% Ni; at the most 4% Si, at the most 2% Mn (all in atomic-%); and the remainder Fe besides normally present impurities in low amounts.

(2) 18–30% Ti, Zr and/or Hf; 15–33% C and/or N; 2–15% Mn; at the most 3% Cr; at the most 2% Mo; at the most 3% Ni (all in atomic-%); and the remainder Fe besides normally present impurities.

(3) 12–30% Ti, Zr and/or Hf; 12–33% C and/or Hf; 12–33% C and/or N; at the most 16% Cr; at the most 10% W; at the most 10% Mo; at the most 10% Al (all in atomic-%); and the remainder Fe, Co and/or Ni besides normally present impurities.

The alloy of the invention can be prepared by means of powder metallurgical methods. The ingredients as such, hard components, pre-alloys or the alloy in powder form can be the raw material. In case the alloy according to the invention is used as a raw material it can be prepared as a powder by the method of arc-melting consumable electrodes rotating along their longitudinal axes. The powdered raw materials are suitably milled in a milling equipment normally used in the cemented carbide industry. Organic liquids such as acetone, ethyl alcohol, benzene etc. can be used as milling medium, and hard metal balls as milling bodies. It is essential that the milling will result in a fine grained, well mixed powder, which is a condition precedent for the excellent properties of the final sintered alloy.

In preparing an alloy with the nominal compositions (in % by weight) 20 Ti, 7 C, 4 Cr. 4 Mo. 6 W and the remainder essentially Fe, a raw material consisting of carbides of Ti, Cr, Mo and W can be crushed, after which the powder together with carbonyl iron power is fine milled in a rotary ball mill. In the milling which is done with benzene as a milling liquid and with hard metal balls as milling bodies, the mean grain size of the powder has after 25 days' milling been reduced to < 0.1 μm. The powder is dried by driving off the milling liquid by heating in vacuum.

The sintering of the alloy to a dense material of proper character can be done by melt phase sintering of a cold-pressed powder body, or by melt phase sintering of a powder body under pressure — so-called "pressure sintering" —, by isostatic hot pressing, or by forging a powder body in the presence or absence of a melted phase. The final hard components can advantageously be formed in the sintering step.

Sintering in the presence of a melted phase must be done in a short time at the sintering temperature in order to avoid undesired grain growth of the hard components. A method which has been found very suitable is pressure sintering according to so-called "spark sintering". In this method the heating is done by a direct conduction of electric current of such power that high effect generating arcs are formed between the powder grains. In pressure sintering according to the spark-sintering method there are used electrically conducting punches and an electrically isolated. cooled die. A short time supply of current with the heat generation localized only to the powder body and a rapid cooling through the die means that the grain size of the hard components in the final sintered alloy can be kept within the requirements according to the invention.

Dense, homogenous test bodies from finely dispersed powder by means of spark-sintering can be obtained by placing green bodies between the electrically conducting punches and the electrically isolated, water cooled die. By means of an electric current a temperature of 1285° C. (measured by a pyrometer on the inner wall of the die) will soon be reached and the sintering process effected. Suitable conditions are: a pressure of 20 MPa, and a holding time of about 5 min at the reached temperature. In this way a material with satisfactory properties can be obtained.

In hot compacting test bodies in the absence of a melted phase, isostatic hot pressing at a pressure of 100 MPa, a temperature of 1215° C. and a holding time of up to 1 hour has given a desirable result, i.e., full density has been reached without any grain growth of the hard components.

In chip forming machining the alloy has proved superior properties in such applications where high speed is dominating to-day. In comparison with high speed steel made in a conventional or a particle metallurgical way, the alloy has a considerably better wear resistance at low—as well as high— cutting speeds. Wear resistance means in this connection resistance to so-called "flank wear" on the clearance face of the cutting insert, as well as resistance to cratering on the chip face of the cutting insert. It is unique for the alloy that a cutting insert made of the material is worn maintaining a sharp and uniform cutting edge which means that edges of the alloy sharpen themselves. In this way, edges on inserts of the alloy are usable longer than are edges on inserts of other tool materials such as high speed steel. Thus it is possible to increase the number of details per cutting edge, thanks to the better wear resistance and to the maintained sharp edge.

Cutting edges of inserts formed of the new alloy have proved to have exceptionally low sensibility to sticking of material from the work piece. This means that the cutting forces acting on the cutting inserts are less increased by formed bonds between tool and work piece material than in the case of high speed steel tools. The cutting forces are thus limited to the forces required in chip forming. Small tendency of welding or sticking between work piece and cutting faces or edges means reduced heat take-up and temperature raise in the cutting tool.

In comparison with cutting inserts formed of high speed steel, tools formed of the alloy according to the invention have proved to possess superior toughness not only because of excellent strength but also reduced cutting forces by reason of the small friction againt the work piece, the excellent wear resistance and the maintained sharp edge. As cutting tools formed of the alloy according to the invention have very small sensitivity to sticking, chip-forming in intermittent cutting operations proceeds free of interruptions in many cases where high frequency of damage are normal in high speed steel tools. The capacity of the alloy to resist the formation of thermal fatigue cracks in rapid intermittent cutting operations, e.g. in milling or copying turning, has proved to be superior compared to high speed steel. In such cutting operations the cutting tools formed of the alloy of the present invention have given unexpectedly long lives.

The requirement of sharp edges is often inevitable in chip forming machining in which operation high speed steel tools are used and also in shearing of plate material etc., in which conventional heat treatable titanium carbide-rich alloys are used. Suitable properties of the material in the tool facilitate the grinding of a sharp edge. Grinding of inserts and tools formed of the alloy according to the invention has proved the benefit of the alloy in making sharp edges. In this respect, the alloy is different from high speed steel as well as other materials like the mentioned titanium carbide-rich alloys.

EXAMPLE 1

An alloy according to the invention with data given below has been tested by turning together with a cobalt alloyed high speed steel. In the present case the matrix of the alloy was of steel type and contained structure components characteristic of a hardened and tempered steel. The compositions (% by weight) and data of the compared materials were:

| | Alloy according to the invention | Cobalt-alloyed high speed steel |
|---|---|---|
| Ti | 19.5 | — |
| C | 7.0 | 1.25 |
| Cr | 4.2 | 4 |
| Mo | 4.6 | 3.1 |
| W | 6.0 | 9 |
| V | — | 3.1 |
| Co | — | 9 |
| Fe | remainder | remainder |
| Hardness (Vickers) | 1050–1070 | 880 |

Figure 2:
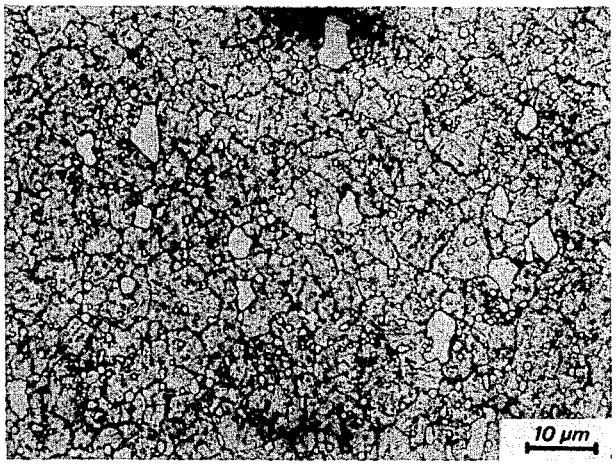
FIG. 2 is a light microscope photomicrograph of a comparison test alloy compositon.

The alloy according to the invention contained 47 percent (by volume) hard components of the kind described in the foregoing text and 53 percent (by volume) matrix. The mean grain size of the hard components was measured at 0.12 μm in a transmission electron microscope, and the distribution of the grain size was measured at a standard deviation of ± 0.05 μm. Less than 1% of hard component grains had a grain size > 1.0 μm. A characteristic structure picture of the alloy according to the invention is given in FIG. 1, which is an electron microscope view because of the extremely fine grained structure. FIG. 2 shows a light microscope picture of this same cobalt-alloyed high speed steel.

The test was performed by finishing as well as by turning under intermittent conditions. The finishing was done at different cutting speeds. The test 1 was a finishing of tubing ϕ 100 mm in steel. The cutting data were:

Cutting speed — 5 m/min
Feed — 0.15 mm/rev.
Cutting dept — 1.5 mm

Figure 3:
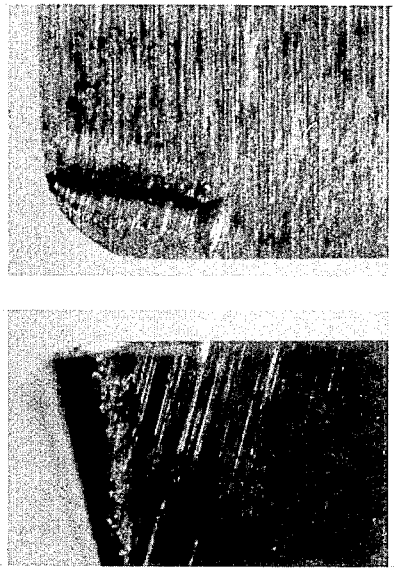
FIG. 3 is a photograph of a cutting insert of the composition of FIG. 1 after 40 minutes of cutting time in a particular test.
Figure 4:
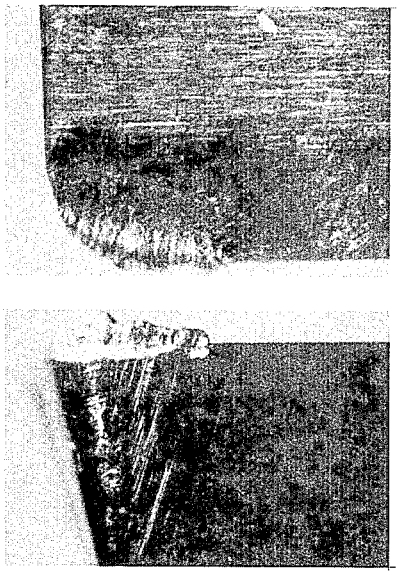
FIG. 4 is a photograph of a cutting insert of the composition of FIG. 2 after 40 minutes of cutting time in a particular test.

The cutting edges were compared after a cutting time of 40 minutes. FIGS. 3 and 4 show the inserts tested. Each figure is composed of two views, one view perpendicular to the chip face and the other view perpendicular to the clearance face of the main cutting edge. The cutting insert formed of the alloy according to the invention (FIG. 3) was free from stuck material; it had a slight cratering and flank wear, the cratering being clearly placed in the chip face. The cutting insert in the cobalt-alloyed high speed steel (FIG. 4) was coated with stuck or welded work piece material; it has a greater cratering and flank wear than the first insert, the cratering starting at the cutting edge. A cratering which starts at some distance from the cutting edge means that the edge can be used up to a considerably greater wear than what is normal.

The flank wear was measured at three places along the cutting edge, as in a nose zone (a) at a fourth of the edge length, a middle zone (b) at half the length of the edge and a work piece surface zone (c) at a fourth of the edge length. The following values of the cratering and the flank wear were obtained:

| | Flank wear, mm in zone | | | Cratering max depth |
|---|---|---|---|---|
| | a | b | c | μm |
| Insert alloy according to the invention | 0.05 | 0.05 | 0.12 | <5 |
| The cobalt alloyed high speed steel | 0.12 | 0.13 | 0.18 | 15 |

Test 2 was a finishing of tubing ϕ 100 mm in steel SIS 1550, using the following cutting data:

| | |
|---|---|
| Cutting speed | 50 m/min |
| Feed | 0.15 mm/rev. |
| Cutting depth | 1.5 mm |

Figure 5:
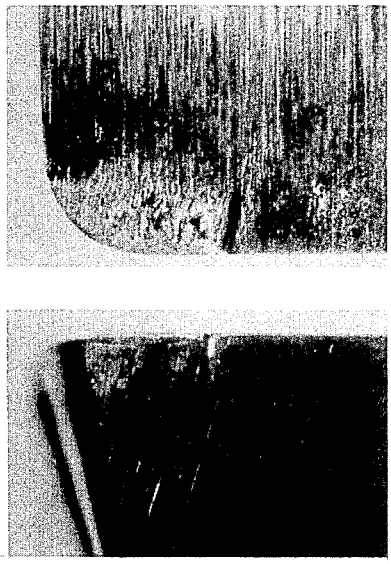
FIG. 5 is a photograph of a cutting insert of FIG. 6 is a photograph of a cutting insert of the composition of FIG. 2 after 20 minutes of cutting time in a particular test.
Figure 6:
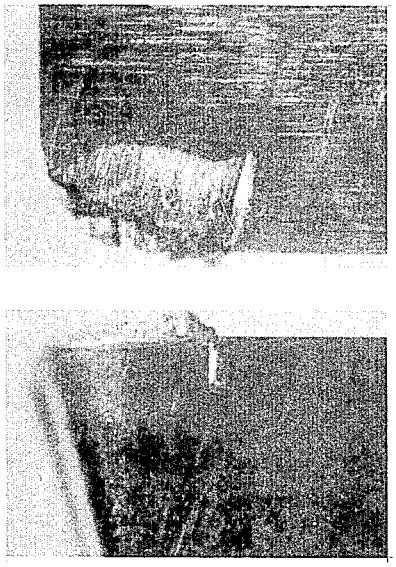

The cutting edges were compared after a cutting time of 20 minutes. FIGS. 5 and 6 show the tested cutting inserts. The insert formed of the alloy according to the invention (FIG. 5) was free from stuck or welded work piece material; it had almost no cratering and a slight flank wear even in surface zone between work piece and insert. The insert formed of the cobalt-alloyed high speed steel (FIG. 6) was considerably coated with work piece material; it had an evident cratering and a certain depression of the cutting edge, and an established flank wear in the work piece zone. The following values of the cratering and the flank wear were determined:

| | Flank wear mm in zone | | | Cratering max. depth |
|---|---|---|---|---|
| Insert | a | b | c | μm |
| Alloy according to the invention | 0.04 | 0.04 | 0.22 | <5 |
| Cobalt-alloyed high speed steel | 0.05 | 0.05 | 0.51 | 35 |

Test 3 was performed at high cutting data for high speed steel. The operation was also in this case a finishing of tubes in steel using the following cutting data:

Cutting speed — 80 m/min
Feed — 0.15 mm/rev.
Cutting dept — 1.5 mm

Figure 7:
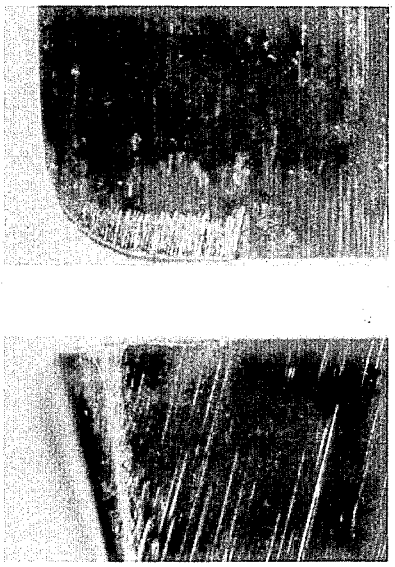
FIG. 7 is a photograph of a cutting insert of the composition of FIG. 1 after 25 minutes of cutting time in a particular test.
Figure 8:
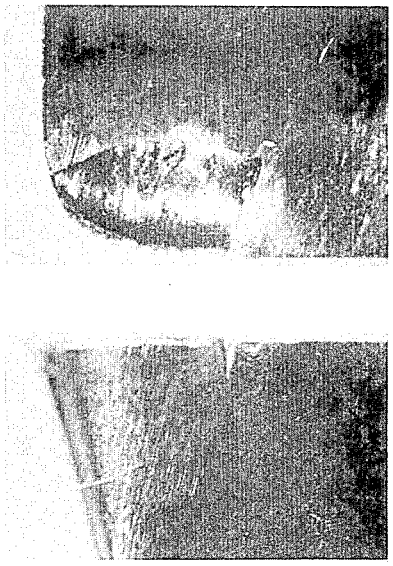
FIG. 8 is a photograph of a cutting insert of the composition of FIG. 2 after 25 minutes of cutting time in a particular test.

The time for the test was 25 minutes. The cutting insert formed of the alloy according to the invention (FIG. 7) had an insignificant cratering and flank wear, which was not the case for the cobalt-alloyed high speed steel (FIG. 8). The following values of wear were measured:

| Insert | Flank wear mm in zone a | b | c | Cratering max. depth μm |
|---|---|---|---|---|
| Alloy according to the invention | 0.09 | 0.06 | 0.07 | <5 |
| Cobalt-alloyed high speed steel | 0.14 | 0.14 | 0.39 | 172 |

Test 4 was a cutting operation with an intermittent course of machining. The work piece was a grooved tube in steel with the diameter ϕ 100 mm. The number of grooves were 4. The grooves were placed symmetrically and each had a width of about 40 mm. The cutting data were:

Cutting speed — 50 m/min
Feed — 0.15 mm/rev.
Cutting depth — 1.5 mm

Figure 9:
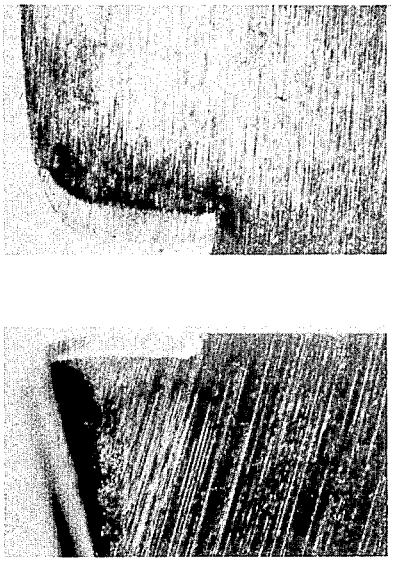
FIG. 9 is a photograph of a cutting insert of the composition of FIG. 1 after 15 minutes of cutting time in a particular test.
Figure 10:
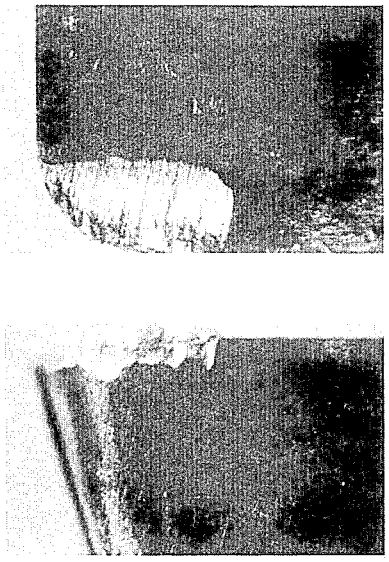
FIG. 10 is a photograph of a cutting insert of the composition of FIG. 2 after 15 minutes of cutting time in a particular test.

The time for the test was 15 minutes. The insert formed of the alloy had no sticking of work piece material, a slight cratering, uniform flank wear and an even, sharp edge, (see FIG. 9). The cutting insert formed of the cobalt-alloyed high speed steel was covered with stuck or welded work piece material, had an evident cratering and an uneven, strong flank wear (see FIG. 10). The following values of the wear were estimated:

| Insert | Flank wear mm in zone a | b | c | Cratering max. depth μm |
|---|---|---|---|---|
| Alloy according to the invention | 0.23 | 0.23 | 0.28 | 5 |
| Cobalt-alloyed high speed steel | 0.30 | 0.40 | 0.39 | 73 |

EXAMPLE 2

Figure 11:
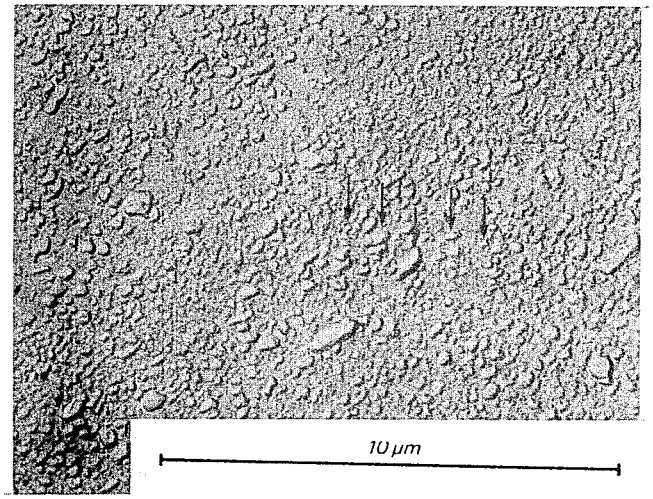
FIG. 11 is a photomicrograph of an alloy composition of the present invention.
Figure 12:
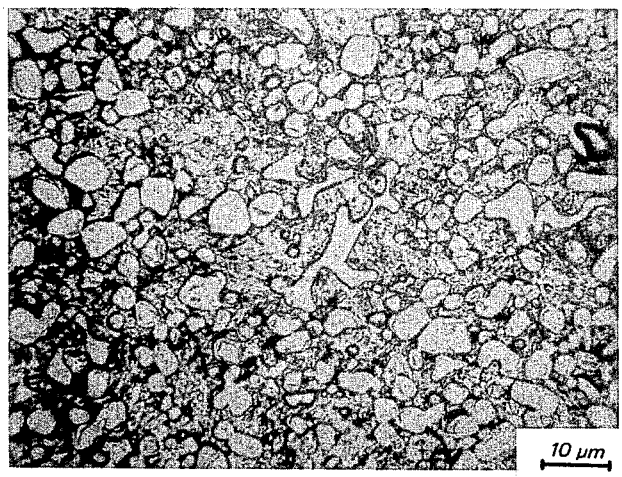
FIG. 12 is a photomicrograph of a comparison test alloy composition.

An alloy according to the invention tested as tool material compared with a conventional, hardenable titanium carbide-containing alloy in punching of plates. The data of the tested alloys were:

| | Alloy according to the invention (A) | The conventional alloy (B) |
|---|---|---|
| Ti | 22.3% | 26.0% |
| C | 7.0% | 7.0% |
| Cr | 2.8% | 2.0% |
| Mo | 3.3% | 2.0% |
| Fe | 64.6% | 63.0% |
| The mean grain size of the hard components | 0.25 μm | 4.0 μm |
| Standard deviation of the grain size distribution | ± 0.10 μm | — |
| Structure picture | FIG. 11 | FIG. 12 |
| Hardness HV | 1050 | 1070 |

The plate had the following data:
C = 0.008%

-continued

| | Alloy according to the invention (A) | The conventional alloy (B) |
|---|---|---|
| Si = 3.15% | | |
| Mn = 0.12% | | |
| S = 0.04% | | |
| Cr = 0.08% | | |
| N = 0.03% | | |
| Mo = 0.02% | | |
| Hardness HV : 185 | | |
| Thickness of the plate : 0.50 mm | | |

Figure 13:
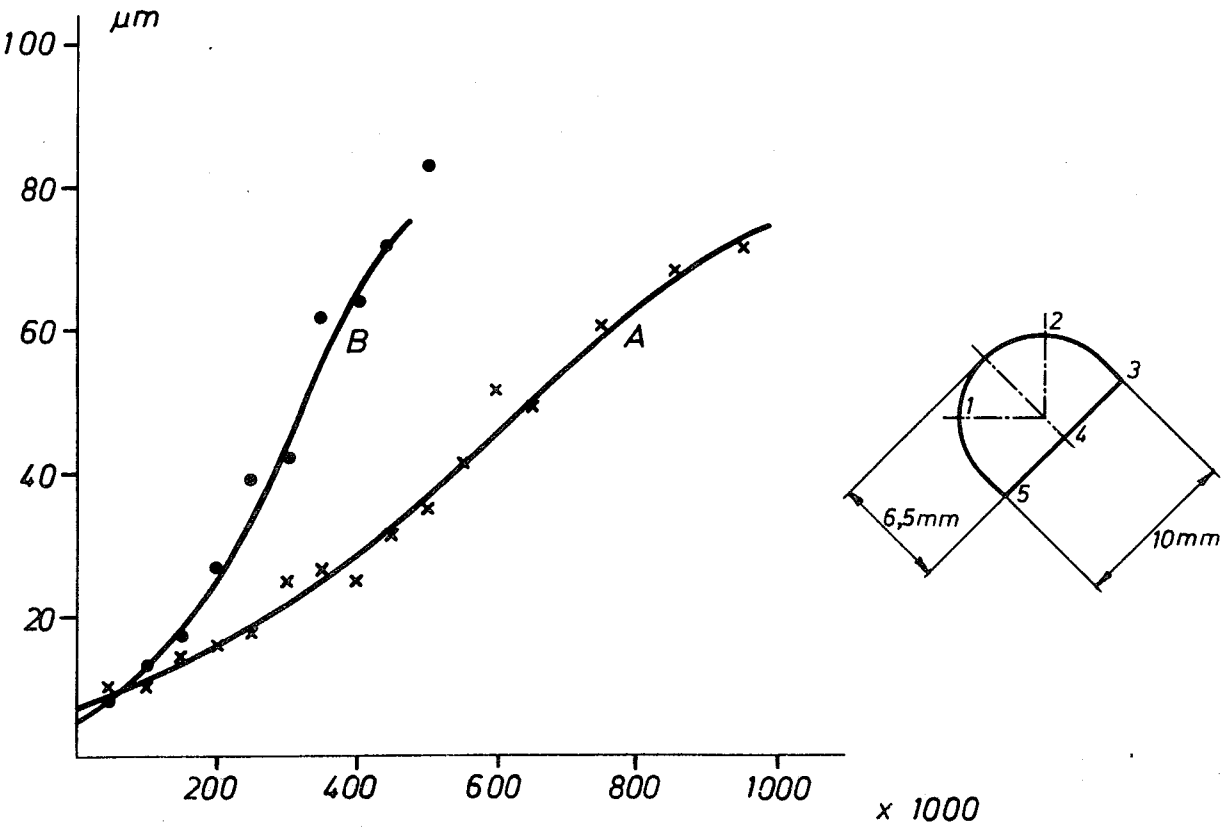
FIG. 13 is a graph of burr test results for a composition of the present invention versus a comparison composition.

With regard to tools it can be mentioned that the contour of the punch was a semi-circle having a plain end surface and a diameter of 10 mm. The punch and die elements were built in a strong pillar stand with prestressed ball bushings. The gap width between punch and die was 30 μm. The speed of the punching was 100 stroke/min and the length of the stroke 30 mm. During the course of the test 20 hole scrap pieces were taken at every 50,000 punchings and the burr height was measured at 5 places. The result of the test is shown in a diagram, FIG. 13, each point being a mean value of the burr height for 5 measure points of 20 hole scrap pieces. From the result it is evident that the punches according to the alloy A have procuced twice as many details as the punches in the conventional alloy B. The worn out limit of the tools were the number of punchings at which the burr height 75 μm was passed.

EXAMPLE 3

An alloy according to the invention with data given below was tested in a turning operation together with a very high alloyed powder high speed steel (as high alloyed as possible by this technique). The matrix of the alloy was of steel type and contained structure components characteristic of a hardened and tempered steel. The composition of the two compared materials were:

| | Alloy according to the invention | High alloyed powder high speed steel |
|---|---|---|
| Ti (% by weight) | 19.8 | — |
| C | 0.5 | 2.3 |
| N | 4.8 | — |
| Cr | 3.8 | 4.0 |
| Mo | 4.5 | 7.0 |
| W | 6.0 | 6.5 |
| V | — | 6.5 |
| Co | 4.0 | 10.5 |
| Fe | remainder | remainder |
| Hardness | 1175 | 1020 Vickers |

The alloy according to the invention contained 42% by volume hard components and 58% by volume matrix. The mean grain size was measured at 0.09 μm, and the standard deviation at ± 0.04 μm. Less than 1% of the number of hard component grains had a grain size > 1.0 μm.

Tests were performed by finishing of tubes ϕ 100 mm in carbon steel using the following cutting data:

Cutting speed: 50 m/min
Feed: 0.15 mm/rev.
Cutting depth: 1.5 mm

The cutting edges were compared after a cutting time of 20 min. The tool formed of the material according to the invetion was free from welded work piece material and there was no cratering. The high speed steel tool had become coated with work piece material and showed severe cratering.

EXAMPLE 4

An alloy according to the invention with the composition given below was wear tested in the shape of teeth of a dredger ladle and was compared with a conventionally used material as so-called "Hadfield steel".

| Alloy according to the invention | |
|---|---|
| Ti | 24 % by weight |
| Mi | 8 |
| Cr | 2 |
| N | 6 |
| O | 1.0 |
| C | 0.8 |
| Fe | remainder |

The alloy contained 45% by volume hard components. The mean grain size of the hard components was measured at 0.11 μm, and their standard deviation at ± 0.04 μm. Less than 1% of the number of hard component grains had a grain size > 0.7 μm.

The "Hadfield steel" was an austenitic manganese steel with the nominal analysis:1% C, 12–14% Mn, remainder Fe. In the test, one half of the teeth of the ladle were made of conventional material and the other half were made of the alloy according to the invention. The work varied between tunneling (loading of stone), loading at a jaw breaker (of stone powder), road building (stone and sand) an in a sand pit (gravel and sand). The teeth made of conventional material had to be changed after 600 hours, while the teeth made of the alloy according to the invention were still running after 2,000 hours.

EXAMPLE 5

An alloy according to the invention with the composition given below was tested as a screening grate in a sintering machine and compared with the material normally used being "Hadfield steel".

The alloy according to the invention had the following composition in % by weight: 18.5 Ti, 9.2 W, 3.0 Mo, 3.5 Co, 8.0 Cr, 3.0 Al, 2.0 B, 5.2 N, 0.3 C, 9.0 Fe and the remainder Ni. The alloy contained 42% by volumes hard components with a mean grain size of 0.10 μm, and their standard deviation was ± 0.04 μm. The alloy had been heat-treated 4 hours at 1100° C. and 16 hours at 800° C.

The alloy according to the invention showed no wear after 4 weeks, which was the normal life of the Hadfield steel in this use.

EXAMPLE 6

An alloy according to the invention was compared with a conventional heat-treatable titanium carbide-containing alloy in a grinding and polishing test. The data of the compared alloys were:

| | Alloy according to the invention | The conventional alloy |
|---|---|---|
| Ti | 24 | 27.5 |
| C | 1.5 | 7.5 |
| N | 6.0 | — |
| Cr | 8.0 | 14.0 |
| Mo | 1.0 | 3.0 |
| Mn | 0.5 | 1.0 |
| V | — | 0.5 |

-continued

| | Alloy according to the invention | The conventional alloy |
|---|---|---|
| Cu | — | 0.8 |
| Fe | remainder | remainder |
| Hardness HV | 1150 | 1030 |
| The mean grain size of the hard components | 0.10 μm | 5 μm |
| The standard deviation of the grain size distribution | ± 0.04 μm | — |

Under the same grinding and polishing conditions, the conventional alloy showed scratches of similar size as the grain size of the hard components, while the extremely fine grained alloy according to the invention gave no scratches at all.

We claim:

1. An alloy consisting essentially of from 30 to 70 volume percent of grains of hard components in a metal binder, the hard components being predominantly nitride and/or carbonitrides and consisting essentially of a compound of at least one member of the group consisting of Ti, Zr, Hf, V, Nb, Ta, Cr, Mo and W and at least one member of the group consisting of C, N and B, in which alloy the molar ratio of N to N plus C is at least 0.6, the hard components have a mean grain size M within the range of 0.04 to 0.70 microns and a grain size distribution represented by the standard deviation S in which $S^2 = (m)/(1+1.5M^2)\mu m^2$, the number of hard component grains being greater than 1.2 μm being 15 percent or less, the metal binder consisting essentially of Fe, Co or Ni and containing 10 atomic percent max. Al, 15 atomic percent max. Mn, 4 atomic percent max. Si and 1 atomic percent max. Cu, the molar ratio (Ti + Zr + Hf + V + Nb + Ta + Cr + Mo + W + Al): (Fe + Co + Ni + Mn) being in the range of from 0.25 to 0.70, the molar ratio of (V + Nb + Ta + Cr + Mo + W): (Ti + Zr + Hf) being 0 to 1 and the molar ratio of (Ti + Zr + Hf + V + Nb + Ta): (Cr + Mo + W) in the hard components being greater than 25.

2. Alloy according to claim 1 in which 0 to 20 percent of the amount of C, N and/or B consists of 0.

3. Alloy according to claim 1, which consists of 15–30 atomic-% Ti, Zr and/or Hf, 15–33 atomic-% C and/or N; ≦ 6 atomic-% Cr; ≦ 6 atomic-%; ≦ 4 atomic-% W; ≦12 atomic-% Co;≦3 atomic-% Ni; ≦4 atomic-% Si; ≦2 atomic-% Mn; and the remainder Fe, in which normally present low contents of impurities are included.

4. Alloy according to claim 1, which consists of 18–30 atomic-% Ti, Zr and/or Hf; 15–33 atomic-% C and/or N; 2–15 atomic-% Mn; ≦3 atomic-% Cr ≦ 3 atomic-% Mo; ≦ 3 atomic-% Ni; and the remainder Fe, in which normally present low contents of impurities are included.

5. Alloy according to claim 1, which consists of 12–30 atomic-% Ti, Zr and/or Hf; 12–33 atomic-% C and/or N; ≦16 atomic-% Cr; ≦ 10 atomic-% W; ≦10 atomic-% Mo; ≦10 atomic-% Al; and the remainder Fe, Co and/or Ni, in which normally present low contents of impurities are included.

6. Alloy according to claim 1, in cutting insert of the composition of FIG. 1 after 20 minutes of cutting time in a particular test.

FIG. (matrix) amounts to at least 50% by weight of the total alloy.

* * * * *